US008705681B2

(12) United States Patent
Srivastava et al.

(10) Patent No.: US 8,705,681 B2
(45) Date of Patent: Apr. 22, 2014

(54) PROCESS AND TARGETS FOR PRODUCTION OF NO-CARRIER-ADDED RADIOTIN

(75) Inventors: Suresh C. Srivastava, Setauket, NY (US); Boris Leonidovich Zhuikov, Moscow region (RU); Stanislav Victorovich Ermolaev, Moscow region (RU); Nikolay Alexandrovich Konyakhin, Kaluga region (RU); Vladimir Mikhailovich Kokhanyuk, Moscow region (RU); Stepan Vladimirovich Khamyanov, Kaluga region (RU); Natalya Roaldovna Togaeva, Kaluga region (RU)

(73) Assignee: Brookhaven Science Associates, LLC

( * ) Notice: Subject to any disclaimer, the term of this patent is extended or adjusted under 35 U.S.C. 154(b) by 1518 days.

(21) Appl. No.: 11/962,851

(22) Filed: Dec. 21, 2007

(65) Prior Publication Data

US 2011/0216867 A1 Sep. 8, 2011

(30) Foreign Application Priority Data

Dec. 29, 2006 (RU) ..... 2006147199

(51) Int. Cl.
*G21G 1/10* (2006.01)

(52) U.S. Cl.
USPC ..... 376/190; 376/156

(58) Field of Classification Search
USPC ..... 376/100, 105, 108, 146, 147, 148, 151, 376/156, 157, 190–201; 250/492.1
See application file for complete search history.

(56) References Cited

U.S. PATENT DOCUMENTS 3,228,850 A * 1/1966 Fellows ..... 376/323
5,342,283 A 8/1994 Good (Continued)

FOREIGN PATENT DOCUMENTS

EP 0 840 538 * 5/1998 ..... H05H 6/00
EP 0 840 538 A 5/1998

(Continued)

OTHER PUBLICATIONS

Mausner et al, Nuclear data for production of 117mSn for biomedical application, J. Radiation Effects, 1986, pp. 59-63, vol. 94, Gordon and Breach Science Publishers, Inc., Great Britain.*

(Continued)

*Primary Examiner* — Jack W Keith
*Assistant Examiner* — Marshall O'Connor
(74) *Attorney, Agent, or Firm* — Wood, Herron & Evans, LLP

(57) ABSTRACT

One embodiment of the present invention includes a process for production and recovery of no-carrier-added radioactive tin (NCA radiotin). An antimony target can be irradiated with a beam of accelerated particles forming NCA radiotin, followed by separation of the NCA radiotin from the irradiated target. The target is metallic Sb in a hermetically sealed shell. The shell can be graphite, molybdenum, or stainless steel. The irradiated target can be removed from the shell by chemical or mechanical means, and dissolved in an acidic solution. Sb can be removed from the dissolved irradiated target by extraction. NCA radiotin can be separated from the remaining Sb and other impurities using chromatography on silica gel sorbent. NCA tin-117m can be obtained from this process. NCA tin-117m can be used for labeling organic compounds and biological objects to be applied in medicine for imaging and therapy of various diseases.

32 Claims, 4 Drawing Sheets

(56) References Cited

U.S. PATENT DOCUMENTS

| | | | |
|---|---|---|---|
| 5,425,063 | A | 6/1995 | Ferrieri et al. |
| 5,853,695 | A | 12/1998 | Srivastava et al. |
| 2007/0034373 | A1 | 2/2007 | McDaniel et al. |

FOREIGN PATENT DOCUMENTS

| | | | |
|---|---|---|---|
| RU | 2122251 | | 11/1998 |
| WO | 2006/074960 | A | 7/2006 |

OTHER PUBLICATIONS

Qaim et al., "Production of Carrier-free 117m Sn," Int. J. Appl. Radiat. Isot, Vol, 35, No. 7, pp. 645-650 (1984).*

Mausner et al, Improved Specific Activity of Reactor Produced 117mSn with szilard-chalmers process, International journal of radiation applications and instrumentation. Part A, Applied radiation and isotopes. 1992, pp. 1117-1122, Vo143, ISSN: 0883- 2889/ OCLC121015, Pergamon Presss Ltd, Great Britain.*

Ermolaev et al., Production yields of 117mSn from natural antimony target in proton energy range 145-35 MeV, Journal of Labeled Compounds and Radiopharmaceuticals, 2007, pp. 611-612, 50, J Wiley & Sons, Ltd.*

International Searhing Authority; Invitation to Pay Additional Fees with corresponding Partial International Search Report, mailed May 28, 2009, 4 pp.

Mausner et al, Improved Specific Activity of Reactor Produced 117mSn with szilard-chalmers process, International journal of radiation applications and instrumentation. Part A, Applied radiation and isotopes. 1992, pp. 1117-1122, vol. 43, ISSN: 0883-2889/ OCLC121015, Pergamon Presss Ltd, Great Britain.

Yu.G. Toporov et al., High Specific Activity Tin-117m Reactor Production at RIAR, J. Abstracts of the 9th International Symposium on the Synthesis and Applications of Isotopes and Isotopically Labelled Compounds, Jul. 2006, p. 64, Edinburgh, UK.

Stanislav V. Ermolaev et al., Production yields of 117mSn from natural antimony target in proton energy range 145-35 MeV, Journal of Labelled Compounds and Radiopharmaceuticals, 2007, pp. 611-612, 50, J Wiley & Sons, Ltd.

Y.G. Toporov et al, High specific activity Tin-177m reactor production at RIAR, Abstract Book 5th International Conference on Isotopes, Apr. 2005 , p. 24, Brussels Belgium.

Qaim et al., "Production of Carrier-free 117m Sn," Int. J. Appl. Radiat. Isot, vol. 35, No. 7, pp. 645-650 (1984).

* cited by examiner

PROCESS AND TARGETS FOR PRODUCTION OF NO-CARRIER-ADDED RADIOTIN

GOVERNMENT RIGHTS

This invention was made with government support under contract number DE-AC02-98CH10886, awarded by the U.S. Department of Energy, and Research Program of Russian Academy of Sciences #01.2.00 305488. The U.S. Government has certain rights in the invention.

FIELD OF THE INVENTION

The field of the invention relates to nuclear technology and radiochemistry, and more specifically, to the production of a radionuclide of tin in no-carrier-added (NCA) form for labeling organic compounds and biological materials and for molecular imaging and therapy of various diseases.

BACKGROUND OF THE INVENTION

A method for the production of $^{117m}$Sn is irradiation of enriched $^{116}$Sn by thermal neutrons in a nuclear reaction $^{116}$Sn (n, γ) $^{117m}$Sn (Mausner et al., Improved Specific Activity of Reactor Produced $^{117m}$Sn with the Szilard-Chalmers Process, J. Appl. Radiat. Isot., 43, 1117-1122 (1992)). The highest specific activity of $^{117m}$Sn (ratio of activity to total mass of all Sn isotopes) achieved by this method (neutron flux $2.5 \cdot 10^{15}$ n/(cm$^2$s)) did not exceed 2 Ci/g. This was because of the low cross section in the nuclear reaction $^{116}$Sn (n, γ) $^{117m}$Sn.

Another method is based on the inelastic neutron scattering reaction using enriched $^{117}$Sn as a target (nuclear reaction $^{117}$Sn (n, n', γ) $^{117m}$Sn) (Toporov et al., High Specific Activity Tin-117m Reactor Production at RIAR, Abstracts of the 9$^{th}$ International Symposium on the Synthesis and Applications of Isotopes and Isotopically Labelled Compounds, July 2006, Edinburgh, UK). It requires neutrons with energy higher than 0.1 MeV. Following dissolution of the tin-117 irradiated with a flux $2 \cdot 10^{15}$ n/(cm$^2$s), and chemical purification, $^{117m}$Sn of specific activity up to 20 Ci/g can be achieved.

These methods result in low specific activity of $^{117m}$Sn inadequate to scale up to therapeutic doses and too low for radioimmunotherapy (RIT). No carrier added (NCA) isotope is required for these applications. One method that provides $^{117m}$Sn in NCA form (Mausner et al., Nuclear data for production of $^{117m}$Sn for biomedical application, J. Radiation Effects, 94, 59-63 (1986)) is irradiation of natural or enriched antimony (Sb) with accelerated protons, dissolution of the irradiated target, and recovery of NCA radioactive tin (radiotin) from the solution. However, the proton current in this method did not exceed 0.15 μA and thus did not result in $^{117m}$Sn with high specific activity.

In one report cited above (Yu. G. Toporov et al., High Specific Activity Tin-117m Reactor Production at RIAR, Abstracts of the 9$^{th}$ International Symposium on the Synthesis and Applications of Isotopes and Isotopically Labelled Compounds, July 2006, Edinburgh, UK, p. 64), a target prepared of stable enriched metallic $^{117}$Sn enclosed in a quartz capsule inside an aluminum container was used to produce radiotin. However, this target when neutron irradiated did not result in specific activity of $^{117m}$Sn higher than 20 Ci/g.

In another report (Mausner et al., J. Radiation Effects, 94, 59 (1986) cited above), a target made of thin films of antimony (thickness 1-3 μg/cm$^2$), prepared by evaporating antimony onto a copper backing, was used to produce radiotin.

The beam current used with this target did not exceed 0.15 μA, and did not result in $^{117m}$Sn with high specific activity.

In another report (Kurina et al., Device for Producing Radionuclides, Russian Patent No. 2122251 (published Nov. 20, 1998)), a target of irradiated material was inserted into a hermetic shell. However, Sb-target material in this report was not mentioned or considered for use.

Additional methods are thus desirable.

SUMMARY OF THE INVENTION

One embodiment of the invention is a method for producing no-carrier-added radioactive tin (NCA radiotin). A target containing metallic antimony (Sb), natural or enriched antimony, in the form of a monolith metal and encapsulated by a hermetic shell, is irradiated with a beam of accelerated charged particles. The metallic antimony is then dissolved and NCA radiotin is isolated from the solution. The hermetic shell can be a material substantially resistant to interaction with antimony at high temperature.

Irradiated antimony is removed from the shell. The antimony can be dissolved in an aqueous solution comprising concentrated acid HX where X=F, Cl, or Br with addition of concentrated nitric acid in amounts typically not less than $1/20^{th}$ of the volume of HX. If the solution concentration differs from 9 M to 12 M HX and 0.3 M to 0.9 M Sb, the solution can be adjusted to a concentration of 9 M to 12 M HX and 0.3 M to 0.9 M Sb by evaporation, dilution with water, or addition of HX, or, if the HX used is other than HCl, by evaporation to dryness and dissolution of the residue with the HX other than HCl. To extract Sb from the solution, dibutyl ether can be added to the solution, where dibutyl ether is saturated with the same HX acid and is the same concentration as in the initial Sb-solution. The volume ratio of Sb-solution and dibutyl ether ranges from 1:1-1.5. The organic and water phases are mixed and then permitted to settle. The organic phase containing Sb is removed. Sodium citrate can be added into the water phase to achieve a concentration of citrate ions in the resulting solution not less than 0.5 M and not less than five times more than the Sb-concentration in the solution. The excess $H^+$ ions in the solution can be neutralized by adding alkali to achieve a pH ranging from pH 4.5 to pH 6. To further separate NCA radiotin from Sb, the solution can be passed through a chromatographic column filled with hydrated silicon dioxide ($SiO_2 \cdot xH_2O$), as Sn is preferentially adsorbed by the hydrated silicon dioxide. The remaining amounts of Sb and radioactive tellurium (Te) and indium (In) can be washed from the hydrated silicon dioxide of the column using a citrate solution with pH ranging from pH 4.5 to pH 6.0, and followed by water with citric acid at a pH ranging from pH 4.5 to pH 6.0. NCA radiotin can be desorbed from the hydrated silicon dioxide by inorganic acid at a concentration ranging from 5 M to 7 M.

One embodiment is a target for producing no-carrier-added radiotin. An irradiated sample of monolith metallic antimony is placed into hermetically sealed shell. In one embodiment the monolith of metallic antimony ranges in thickness from 2 mm to 30 mm. The hermetically sealed shell can be made of a material resistant to Sb when the shell is in a flow of cooling liquid during irradiation.

In another embodiment, a method is used for producing no-carrier-added radioactive tin (NCA radiotin). The method comprises irradiating a target with at least a 10 μA beam of accelerated charged particles and recovering NCA radiotin from the irradiated antimony sample. The target comprises a metallic antimony monolith sample encapsulated by a hermetic shell comprising a material substantially resistant to interaction with antimony.

In still another embodiment is a target for producing no-carrier added radioactive tin (NCA radiotin). The target comprises an irradiated block metallic antimony sample, and a shell hermetically encapsulating the sample. The shell has an inlet window and an outlet window for irradiation of the target by a beam of accelerated particles, and the shell is rendered substantially resistant to interaction with antimony. The shell comprises a compound selected from the group consisting of stainless steel, metallic molybdenum, and hard non-porous graphite.

Another embodiment includes an NCA radiotin produced by irradiating a target comprising a metallic antimony block sample with at least a 10 μA high intensity beam of accelerated protons. The sample is encapsulated by a hermetic shell comprising a material substantially resistant to interaction with the antimony sample to result in irradiated antimony. The irradiated sample is removed and NCA radiotin is recovered.

In another embodiment there is a method for producing a target that comprises (a) providing a metallic antimony powder sample to a shell, (b) heating the shell-encased sample to a temperature sufficient to melt the antimony powder in the absence of at least one of antimony sublimation or reaction with the shell in the absence of oxygen, (c) repeating step (b) after a time sufficient for antimony shrinkage, and (d) hermetically sealing the shell to encase the sample.

In still another embodiment there is a method for producing a target, that comprises (a) providing pressed metallic antimony powder sample to a shell, (b) hermetically sealing the shell to encase the sample in the absence of oxygen, and (c) heating the shell-encased sample to a temperature around the melting point of antimony.

In still another embodiment, there is a method to separate NCA radiotin from a target comprising an irradiated antimony sample encased in a shell. The shell has an inlet and outlet windows for a radiation source, and the method comprising (a) removing the target from the shell, (b) dissolving the irradiated antimony in an aqueous solution comprising hydrohalogenic acid and nitric acid, (c) extracting the aqueous solution with an organic phase, and (d) purifying NCA radiotin from the extracted aqueous solution phase.

These and other embodiments will be apparent from the following detailed description and examples.

BRIEF DESCRIPTION OF THE DRAWINGS

These and other features, aspects, and advantages of the present invention will become better understood with regard to the following description, claims and accompanying drawings wherein:

FIG. 2 shows an embodiment of a target design using an austenitic high-alloy steel shell for irradiation in proton accelerators. FIG. 2A shows the target body 10 surrounding a monolith of metallic antimony 12 and a fitting 18. FIG. 2B shows the inlet beam window 14 and outlet beam window 16;

FIG. 3 shows an embodiment of a target design using hot-rolled molybdenum for irradiation in proton accelerators. FIG. 3A shows the target body 30 surrounding a monolith of metallic antimony 32, and the inlet beam window 34. FIG. 3B shows the outlet beam window 36;

FIG. 4 shows an embodiment of a target design using non-porous graphite for irradiation in proton accelerators.

FIGS. 4A and 4B show the target 50 surrounding a monolith of metallic antimony 52. FIG. 4B shows the inlet beam window 54 and outlet beam window 56 and graphite cover 58.

DETAILED DESCRIPTION

Figure 1:
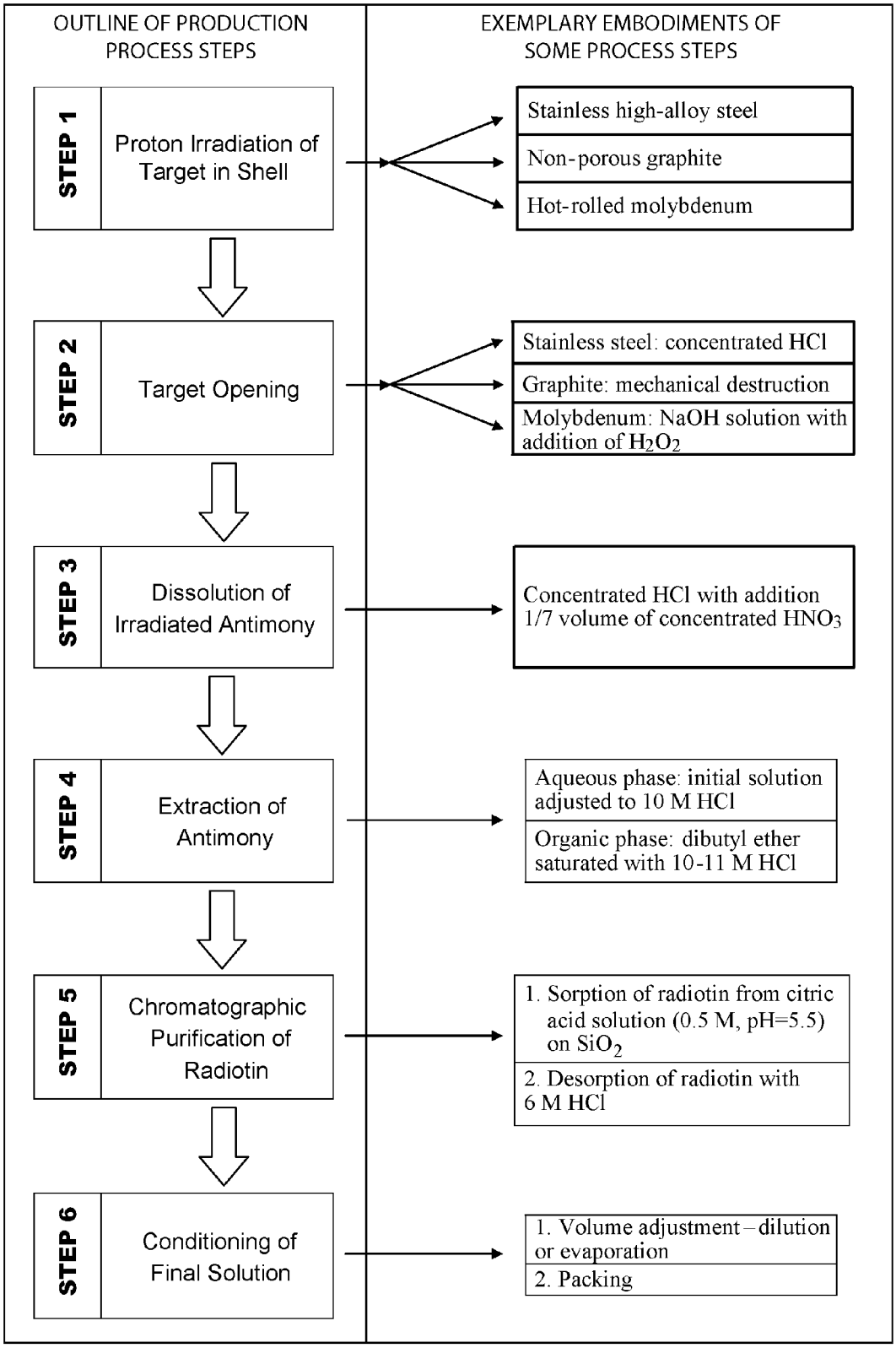
FIG. 1 shows an outline with exemplary embodiments of the production of NCA radiotin.

In one embodiment, an antimony target inserted into a hermetic shell, is irradiated with a beam of charged particles, such as protons. The beam can be a high current beam. After irradiation, the NCA radiotin is isolated from the other atoms and isotopes.

In exemplary embodiments, the target can be natural antimony or enriched antimony. The target can be in the form of massive metallic block, having a thickness, for example, up to several cm. The target can be a monolith.

In an exemplary embodiment, prior to irradiation, metallic antimony in the form of a massive block is inserted into a hermetic shell made of a material substantially resistant to interaction with antimony at high temperature. Substantially resistant to interaction with antimony means that reactions of the heated (i.e., via irradiation) antimony with the shell material are minimized so that, for example, the shell material or products of reactions of the shell with the heated antimony are not found in the irradiated antimony. Substantially resistant to interaction with antimony, as defined above, is also referred as "antimony resistant" in this application. The antimony sample can be 2 mm thick to 30 mm thick. The hermetic shell can be fabricated of a material substantially resistant to interaction with antimony that is cooled during irradiation by a liquid. In one embodiment, the hermetic shell is made of austenitic high-alloy steel with input and output beam window 50 μm thick to 300 μm thick. In another embodiment, the hermetic shell is made of hot-rolled molybdenum with input and output beam window thickness of 50 μm thick to 300 μm thick, where the outer side of the molybdenum shell is plated with a nickel layer 20 μm thick to 70 μm thick. In another embodiment, the hermetic shell is made of non-porous graphite with input and output beam window thickness of 0.5 mm thick to 1.5 mm thick, where the outer side of the molybdenum shell is plated with a nickel layer thickness of 20 μm thick to 70 μm thick. Besides nickel, other or additional shells of different materials with different thickness (e.g., chromium or austenitic nickel-based superalloys such as Inconel, etc.) can be used to protect graphite or molybdenum shell from cooling exterior media, i.e., water under radiolysis.

To obtain the initial antimony monolith in the shell, powder or granulated metallic antimony can be heated at 631° C. to 700° C. in an inert gas atmosphere. In one embodiment, antimony is heated inside the shell. In another embodiment, antimony is heated outside the shell, after which antimony is inserted into the shell. The resulting antimony block can range from 2 mm thick to 30 mm thick.

If austenitic high-alloy steel is used for the antimony-resistant shell, the irradiated metallic antimony target can be removed from the shell after irradiation by dissolving in 8 M HCl to 12 M HCl. If hot-rolled molybdenum is used as the antimony-resistant shell, the shell can be plated on the outside by a shielding layer of metallic nickel, and the irradiated metallic antimony can be removed from the shell by first etching the nickel layer in 0.5 M nitric acid to 2 M nitric acid, then dissolving a part of the molybdenum shell in 3 M alkali solution to 8 M alkali solution with addition of 30% $H_2O_2$ in a volume ratio of 1:0.5-1.2. If non-porous graphite is used for the antimony-resistant shell material, the shell can be plated on the outside by a shielding layer of metallic nickel, and the irradiated metallic antimony can be removed from the shell by first etching the nickel layer in 0.5 M nitric acid to 2 M nitric acid, then mechanically crushing the graphite shell. Alternatively, the graphite shell can be cut away without the preliminary etching of the nickel layer.

After the irradiated antimony is removed from the shell, it can be dissolved in an aqueous solution comprising acid. This acid can be a mixture of hydrohalogenic acid (i.e., HX acid, where X is F, Cl, or Br) and concentrated nitric acid; the volume of concentrated nitric acid can be greater than or equal to $1/20^{th}$ of the HX acid volume. In an exemplary embodiment, the concentration of HX acid is 9 M to 12 M, and the concentration of Sb is 0.3 M to 0.9 M; the HX acid concentration and the Sb concentration can be adjusted by evaporation, dilution with water, addition of HX, or evaporation to dryness and dissolution of the residue in HX solution.

After dissolution, the aqueous solution can be extracted with an organic phase. In one embodiment, dibutyl ether is used as the organic phase. In this embodiment, dibutyl ether is saturated with HX of the same concentration as in the solution of antimony and then added to the antimony solution. The ratio of aqueous volume and dibutyl ether volume can be 1:1-1:1.5. The composition is mixed for 2 to 20 (or 5 or 10) minutes to facilitate antimony extraction, and then allowed to phase separate for 15 to 120 (or 30 or 60) minutes. The organic phase containing antimony is separated from the aqueous phase. To further remove antimony and other unwanted materials, the water phase remaining after extraction can be subject to two to four additional extraction stages.

After the extractions, the aqueous phase can then be passed through a column to further purify the NCA radiotin. The aqueous phase can be prepared for the column by adding alkali. For example, sodium citrate can be added to the aqueous phase so that the citrate concentration no less than 0.5 M and no less than five times the concentration of the antimony in the aqueous phase. The pH can be adjusted to the range of 4.5-6.0 by the addition of the alkali, or to a pH of 5.4, 5.5, or 5.6.

The column can be a chromatography column filled with hydrated silicon dioxide ($SiO_2.xH_2O$). Tin can be adsorbed on the surface of the hydrated silicon dioxide and the column is washed of traces of antimony, Te, and In radioisotopes, with a sodium citrate solution of the same concentration at pH 4.5-6.0, and then with water comprising citric acid (pH 4.5-6.0). NCA radiotin can be desorbed from the hydrated silicon dioxide column by an inorganic acid at a concentration in the range of 5 M to 7 M. The hydrated silicon dioxide column length can be 5 cm-15 cm and the diameter can be 0.5 cm-1.5 cm. The silicon dioxide grain size can be 0.05 mm-0.4 mm. The sorbent washing solution (to remove traces of antimony as well as radioisotopes of Te and In and other unwanted materials) can be 20 ml-70 ml of sodium citrate at a pH 4.5-6.0 or 5.4-5.6. Additional washes can include 30 ml-100 ml of water containing citric acid at a pH 4.5-6.0 or 5.4-5.6. The solutions can be passed through the column at a rate of 0.1 ml/min to 3 ml/min. NCA radiotin is desorbed from the column using 5 ml to 20 ml of an organic or inorganic acid, e.g. 6M HCl. The obtained material can be subjected to one or two additional chromatographic runs to further purify the NCA radiotin, as described above.

Purified NCA radiotin may include contaminants as exemplified in the Examples. NCA radiotin may be substantially purified from one or more stable contaminants or one or more of radioactive contaminants. The Examples provide exemplary embodiments of NCA radiotin that is substantially purified from, for example, various In and Te isotopes.

After one or more of the aforementioned procedures, the NCA radiotin can be conditioned as desired, e.g., by volume adjustment (via dilution or evaporation). The finished product may also be packaged for storage or shipment. Additionally, the NCA radiotin may be processed for use in labeling organic compounds and biological objects to be applied in medicine for therapy of various diseases.

Example 1

Figure 2A:
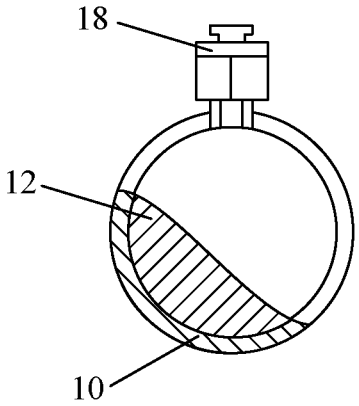
FIG. 2A is a plan view in partial cross section.
Figure 2B:
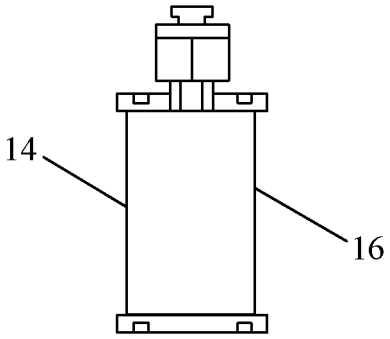
FIG. 2B is a side view.

A powder of metallic antimony was placed into two similar stainless austenitic high-alloy steel shells, as shown in FIG. 2, having a thickness of 17 mm. Placement was through the fitting 18 and under a nitrogen atmosphere in order to avoid oxidation during heating. Both filled shells were heated for 15 min. One shell was heated at 720° C.; the second shell was heat at 645° C.

Heating the first shell at 720° C. resulted in the destruction of the thin target inlet beam window 14 and outlet beam window 16 (thickness 125 μm) because liquid antimony reacted with iron and other components of steel. The reaction rate increased at temperatures above 700° C.

Heating the second shell at 645° C. did not damage the windows. After cooling, this shell was again filled with antimony powder and heated. After cooling, the shell was hermetically sealed with a threaded Swagelok type seal 18.

The target containing 60 g antimony was irradiated over 24 hours at the linear accelerator of the Institute for Nuclear Research (Troitsk, Russia). The proton beam current was 25 μA; the proton energy range was 110-74 MeV. The angle of the beam to the window surface was 65°. The effective thickness of the target of antimony monolith in the beam direction was 19 mm. At the end of irradiation, 160 mCi of $^{117m}$Sn was produced. No evidence of damage was observed. Higher $^{117m}$Sn activity may be produced using a longer irradiation time.

To chemically process the irradiated target, the inlet beam window 14 and outlet beam window 16 foils of the target shell were dissolved with 200 ml concentrated (36 mass %) HCl during 18 hours. No Sb was dissolved. The monolith of metallic Sb was separated from the rest of the shell, washed with HCl, and transferred into a glass container for Sb dissolution.

Sb was dissolved with 450 ml concentrated HCl adding $HNO_3$ over several hours (concentration of initial $HNO_3$ was 56 mass %, the total used volume was 65 ml). A slow dissolution rate was maintained to avoid overheating and excess bubble release. The resulting solution was carefully heated to remove traces of $HNO_3$. The volume of the solution obtained was 420 ml to 430 ml in 9M HCl.

In the following extraction process, the extraction coefficients fall above the 0.9 M Sb concentration. At a Sb concentration below 0.3 M, the solution volumes were too high and made processing technically difficult.

The solution was adjusted to 10 M HCl and its volume was increased to 360 ml to 370 ml. Dibutyl ether ($Bu_2O$) was saturated with 10 M HCl by vigorous stirring over five min utes. Lower HCl concentration led to less extraction, while higher HCl concentrations resulted in co-extraction of Sn. Equal volumes of aqueous and organic phases were taken. Five extraction stages were carried out. Decreasing the number of extraction stages below three resulted in less efficient Sb extraction. Increasing the number of extraction stages above five resulted in increased Sn loss and longer processing procedures, without considerably improved purification. Each mixing was five minutes; each phase separation was 30 minutes.

To prepare the solution for column chromatography of hydrated silica gel, sodium citrate ($Na_3Cit$) was added to the water solution after extraction so that the concentration of citric ions was 0.5 M. The solution was then neutralized to pH 5.5 with NaOH. At lower pH values, Sn breakthrough was observed in the chromatography process. At higher pH values, Sb adsorption on the column was observed, resulting in Sb-impurity in the final product (e.g., see, FIG. 5).

Purification also included using two subsequent chromatographic purification stages with silica gel (hydrated $SiO_2$) columns. Sn was adsorbed by the column, while Sb and radioisotopes of Te and In were not adsorbed by the column. Two to three chromatographic runs were usually sufficient to achieve product purity, while increasing the number of purification run resulted in Sn losses. The solution flow rate through the column ranged from 0.1 ml/min to 3 ml/min. A slower flow rate resulted in longer processing, while a faster flow rate resulted in Sn breakthrough. The first column was filled with grains of 0.2 mm to 0.4 mm, the second column was filled with grains of 0.06 mm to 0.125 mm. Height and diameter of the first column were 15 cm and 1.5 cm, and of the second were 5 cm and 0.5 cm, respectively. Each column was successively washed with 20 ml 0.5 M sodium citrate and 30 ml water acidified by citric acid. The pH values of both washing solutions were adjusted to pH 5.5. $^{117m}$Sn was eluted from each column with 10 ml 6 M HCl.

The specifics of the isolated $^{117m}$Sn solution (calibration date was the 21$^{st}$ day after the end of irradiation) were as follows:

Radionuclidic purity: >99.8% ($^{113}$Sn not included).

Specific activity of $^{117m}$Sn: 1400 Ci/g.

Impurity of $^{113}$Sn: 25%.

Other radionuclides (Bq/Bq $^{117m}$Sn):

| Isotopes | Bq/Bq $^{117m}$Sn |
|---|---|
| $^{118}$Te | $1.1 \cdot 10^{-3}$ |
| $^{119m}$Te | $4.1 \cdot 10^{-4}$ |
| $^{121m}$Te | $1.4 \cdot 10^{-4}$ |
| $^{120m}$Sb | $<10^{-5}$ |
| $^{124}$Sb | $<4 \cdot 10^{-6}$ |
| $^{111}$In | $<10^{-5}$ |

Concentration of stable Sb: <4 μg/ml.

Example 2

Figure 4A:
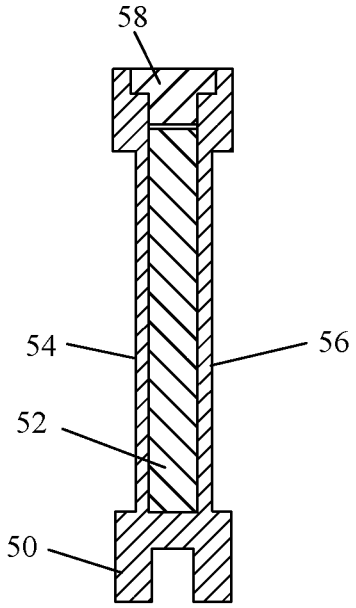
FIG. 4A is a planar view.
Figure 4B:
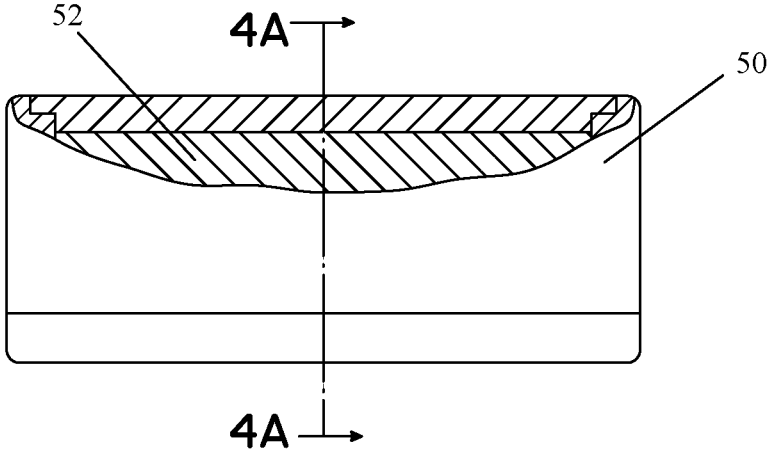
FIG. 4B is a full cross section along line A-A in FIG. 4A, but is not the same scale as FIG. 4A.

A shell made of non-porous graphite, as shown in FIG. 4, was filled with antimony powder and heated at 660° C. over fifteen minutes under nitrogen atmosphere. After cooling, the shell was again filled and heated at 660° C. over fifteen minutes. After the second cooling, a bar of metallic antimony (numeral 52 in FIG. 4) (thickness 3 mm) was removed from the graphite shell and its external surfaces were plated with 60 μm layer of nickel in order to protect graphite from the action of radiolysis water destroying graphite during irradiation under high intensity proton beam. The bar of antimony was again placed into the shell, the target was closed with a cover and hermetically sealed with high temperature radiation stable glue.

The target, containing 19 g Sb, was irradiated over two hours at the linear accelerator of the Institute for Nuclear Research (Troitsk, Russia). The proton current and proton energy range were 70 μA and 66-34 MeV, respectively. The proton beam angle to the target surface was 26°. The effective Sb-target thickness in the beam direction was 7 mm. No damage was detected. Therefore, another irradiation was performed during two days at similar conditions. Approximately 200 mCi $^{117m}$Sn was produced. Larger amounts may be produced using longer irradiations, if necessary.

In the process of recovery, the Ni-layer was first etched off with 1 M nitric acid. The graphite shell (50 in FIG. 4) was crushed with the help of a specially manufactured device. During crushing, thin windows 54, 56 (thickness 0.8 mm) were destroyed, and the graphite shell was easily separated from the bar of irradiated antimony.

All 19 grams of antimony were dissolved with 200 ml concentrated HCl with gradual addition of 56 mass % $HNO_3$ (1/7 of volume) over several hours. When dissolution was complete, the solution was carefully evaporated to remove traces of $HNO_3$. The volume of the obtained solution was 170 ml.

Three extraction stages were performed. Changes from Example 1 include, (a) the volume ratio of the aqueous to organic phases was chosen as 1:1.5, (b) the length of each mixing was increased to ten minutes, and (c) the length of phase separation was increased to 60 minutes.

Chromatographic purification was similar to that described in Example 1, except that the size of grains for the first chromatographic column was decreased to 0.12 mm to 0.2 mm.

The specifics of the isolated $^{117m}$Sn solution (calibration date is 21$^{st}$ day after the end of irradiation) were as follows:

Radionuclidic purity: >96.5% ($^{113}$Sn not included)

Specific activity of $^{117m}$Sn: 500 Ci/g Sn

Impurity of $^{113}$Sn: 9%

Other radionuclides (Bq/Bq $^{117m}$Sn):

| Isotopes | Bq/Bq $^{117m}$Sn |
|---|---|
| $^{119m}$Te | $2.9 \cdot 10^{-2}$ |
| $^{121m}$Te | $4.9 \cdot 10^{-3}$ |
| $^{120m}$Sb | $<6 \cdot 10^{-4}$ |
| $^{124}$Sb | $<3 \cdot 10^{-5}$ |
| $^{114m}$In | $<2 \cdot 10^{-4}$ |

Concentration of stable Sb: <35 μg/ml

In Example 2 the target was in a graphite shell, in contrast to the target in a stainless austenitic high-alloy steel shell as in Example 1. Also in Example 2, the number of extraction stages was decreased from 5 to 3 as well as altering some extraction conditions (see above). This led to simplified processing, giving a less pure but acceptable final product.

Example 3

A stainless high-alloy steel shell in form of disc (FIG. 2) with 9 mm thickness was filled with antimony powder by the same method as described in Example 1 (heating of the filled shell at 660° C.). The target containing 29 g antimony was irradiated at the accelerator over 24 hours. The proton current and proton energy range were 30 μA and 103-72 MeV, respectively. The proton beam angle was 65° to the target surface, and the effective Sb-thickness in the beam direction was 10 mm.

The target was then processed as described in Example 2, except that three stages of both extraction and chromatographic purifications were performed. The duration of phase separation at extraction was 45 minutes. Longer durations of phase separation were demonstrated not to affect the coefficient of antimony extraction or the percentage of radiotin co-extraction.

The specifics of the isolated $^{117m}$Sn solution (calibration date is 8$^{th}$ day after the end of irradiation) were as follows:

Radionuclidic purity: >99.9% ($^{113}$Sn not included)

Specific activity of $^{117m}$Sn: 1260 Ci/g Sn

Impurity of $^{113}$Sn: 16%

Other Radionuclides (Bq/Bq $^{117m}$Sn):

| Isotopes | Bq/Bq $^{117m}$Sn |
|---|---|
| $^{119m}$Te | $<2 \cdot 10^{-6}$ |
| $^{120m}$Sb | $<10^{-6}$ |
| $^{122}$Sb | $<10^{-6}$ |
| $^{111}$In | $<7 \cdot 10^{-8}$ |

Concentration of stable Sb: <4 μg/ml.

In Example 3 the target was a steel shell, and three stages of chromatography, in contrast to two stages in the previous examples, were used. This resulted in a longer processing time but better purity of the product.

Example 4

Figure 3A:
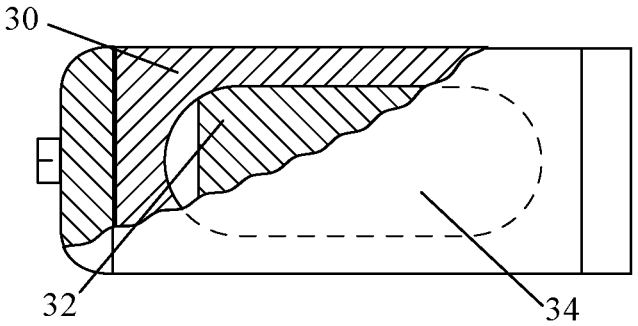
FIG. 3A is a plan view in partial cross section.
Figure 3B:
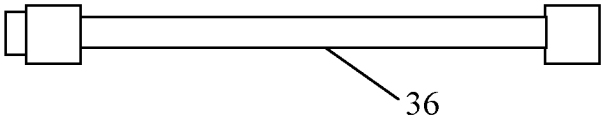
FIG. 3B is a side view.

A hot-rolled molybdenum shell 30 (FIG. 3) was filled with antimony powder as described in Example 1. The external surfaces of the shell were plated with 20 μm layer of nickel in order to protect it from the action of radiolysis water destroying molybdenum during irradiation with the high intensity proton beam. The target containing 19 g antimony (Sb-thickness 3 mm) was irradiated at the accelerator during 1 hour in order to test target stability. Proton current and proton energy ranges were 52 μA and 70-30 MeV, respectively. The proton beam angle to target surface was 26°, and Sb-thickness in the beam direction was 7 mm. No target damage was detected, thus larger amounts of $^{117m}$Sb may be produced in such targets using longer irradiation, if necessary.

The irradiated target was left immersed in 1 M $HNO_3$ for 10 hr to 12 hr to etch the nickel layer. The thin molybdenum inlet 3 and outlet 4 windows (thickness 80 μm) were dissolved with 100 ml 6 M NaOH during five hours with periodic additions of small amount of 30% $H_2O_2$. A 5 M to 7 M concentration of NaOH dissolved the molybdenum target windows. At lower alkali concentrations dissolution was too slow, while at a concentration of 8 M or above there was essentially no increase in dissolution rate. The total volume of hydrogen peroxide used was 120 ml. No Sb dissolution was observed under these conditions. The metallic antimony was then processed as described in Example 2, except that the pH values of the initial solution and both washing solutions were chosen to be within pH 4.7 to pH 5.0 in order to determine the limits of applicability of the chromatographic method used. The wash solution volumes were increased: the volume of sodium citrate was up to 70 ml, and water was up to 100 ml. As a result, the losses of radiotin grew to 10% for each stage of chromatographic separation.

Figure 5A:
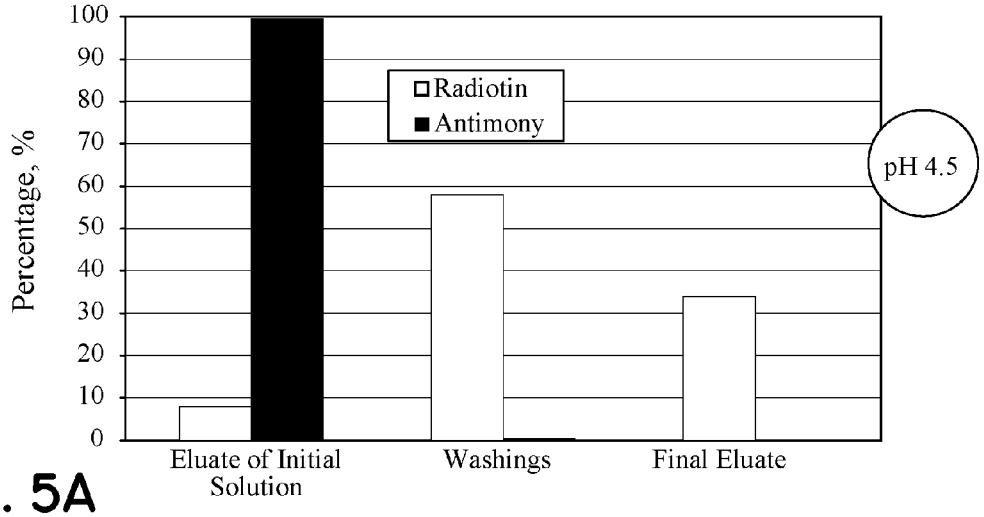
FIG. 5 shows results of radiotin and antimony chromatography sorption using a citrate solution at pH 4.5 (FIG. 5A), pH 5.5 (FIG. 5B), and pH 6.5 (FIG. 5C), with desorption by 6M HCl.
Figure 5B:
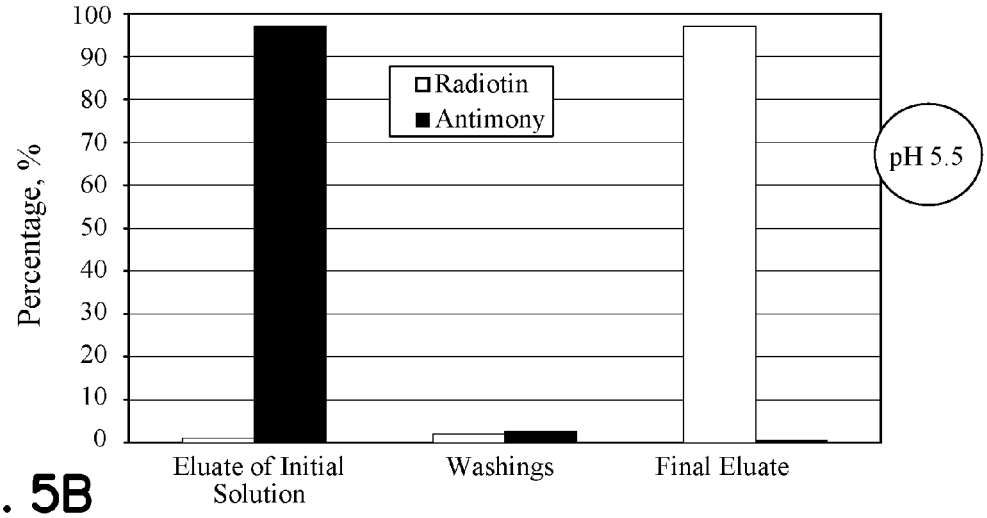
Figure 5C:
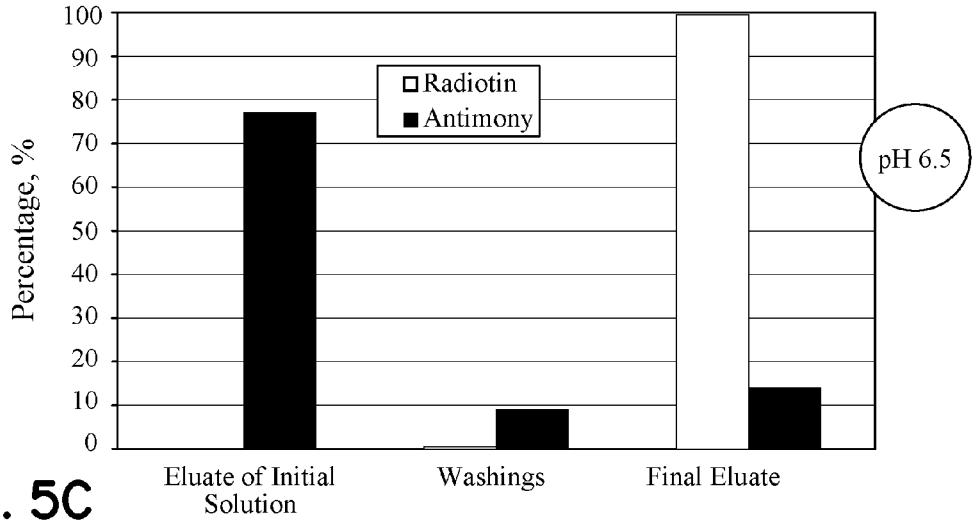

FIG. 5 demonstrates the results of radiotin sorption from citric solutions at different pH values; the pH range was from pH 4.5 to pH 6.0. In FIG. 5*b*, the pH range was from pH 5.4 to pH 5.6.

The specifics of the isolated $^{117m}$Sn solution (calibration date is 15$^{th}$ day after the end of irradiation) were as follows:

Radionuclidic purity: >99.7% ($^{113}$Sn not included)

Specific activity of $^{117m}$Sn: 500 Ci/g Sn

Impurity of $^{113}$Sn: 7%

Other radionuclides (Bq/Bq $^{117m}$Sn):

| Isotopes | Bq/Bq $^{117m}$Sn |
|---|---|
| $^{119m}$Te | $1.3 \cdot 10^{-3}$ |
| $^{121m}$Te | $<8 \cdot 10^{-5}$ |
| $^{120m}$Sb | $1.1 \cdot 10^{-3}$ |
| $^{124}$Sb | $<2 \cdot 10^{-5}$ |
| $^{114m}$In | $<2 \cdot 10^{-4}$ |

Concentration of stable Sb: 20 μg/ml.

Example 4 demonstrated the possibility of irradiating and processing a Sb-target in a molybdenum shell. Example 4 also demonstrated that altering some processing parameters (e.g., pH of the initial solution in chromatography, see above) led to some product losses.

Thus, this invention enabled a high production rate, from massive Sb-target irradiated by high intensity beam, of NCA radiotin having specific activity (500-1000 Ci/g and higher) with a good chemical and radionuclidic purity. This $^{117m}$Sn product may be used in bone cancer therapy, in therapy of cardiovascular disease, in therapy of other diseases, etc. The method provided purification coefficients from Sb $\mathbf{8 \cdot 10^5}$ to $3 \cdot 10^6$ and higher if needed. Radionuclidic purity of $^{117m}$Sn achieved after irradiation was 97-99.8% ($^{113}$Sn was not taken into account) and higher if needed.

Other variations and embodiments will be apparent to one of ordinary skill in the art from the above description and examples. Thus, the foregoing embodiments are not to be construed as limiting the scope of the following claims.

While the foregoing description has set forth preferred embodiments of the present invention in particular detail, it must be understood that numerous modifications, substitutions, and changes can be undertaken without departing from the true spirit and scope of the present invention as defined by the ensuing claims. The invention is therefore not limited to specific embodiments as described but is only limited as defined by the following claims.

What is claimed is:

1. A method for producing no-carrier-added radioactive tin (NCA radiotin), the method comprising irradiating a target with at least a 10 μA beam of accelerated charged particles, wherein the target comprises a metallic antimony monolith sample encapsulated by a hermetic shell comprising a material substantially resistant to interaction with antimony to form an irradiated antimony sample, removing the irradiated antimony sample from the shell by dissolving said irradiated antimony sample to form a dissolved antimony sample in an aqueous phase resulting in NCA radiotin with a specific activity of at least 500 Ci/g, and recovering NCA radiotin from the dissolved irradiated antimony sample by adding an organic phase to said aqueous phase and recovering said radiotin in said aqueous phase.

2. The method of claim 1 wherein the target comprises antimony monolith sample is obtained by melting antimony inside the shell at 631° C. to 700° C., or melting antimony outside the shell at 631° C. to 700° C. and inserting the cooled antimony monolith sample into the shell.

3. The method of claim 1 wherein the shell comprises stainless austenitic high-alloy steel.

4. The method of claim 1 wherein the shell comprises metallic molybdenum.

5. The method of claim 1 wherein the shell comprises hard non-porous graphite.

6. The method of either claim 4 or claim 5 wherein the shell external surface is protected from exterior coolant by a material stable to this coolant under irradiation.

7. The method of either claim 4 or claim 5 wherein the shell external surface is coated with metallic nickel at a thickness ranging from 20 μm to 60 μm.

8. The method of claim 3 wherein the metallic antimony has a thickness of from 2 mm to 30 mm, and the shell has a beam inlet window and an outlet window, the shell at the inlet and outlet windows having a thickness of from 50 μm to 300 μm.

9. The method of claim 5 wherein the thickness of metallic antimony ranges from 2 mm to 30 mm, and the shell has a beam inlet window and an outlet window, the thickness of the shell at the inlet and outlet windows ranging from 0.5 mm to 1.5 mm.

10. The method of claim 3 further comprising dissolving the shell with 8 M HCl to 12 M HCl.

11. The method of claim 7 wherein the nickel coating is etched by 0.5 M to 2 M nitric acid, and the molybdenum shell is dissolved in 3 M to 8 M NaOH with adding hydrogen peroxide.

12. The method of claim 1 wherein the shell comprises hard non-porous graphite that is opened after irradiation by mechanical destruction and irradiated antimony is mechanically isolated from graphite.

13. The method of claim 1 wherein the aqueous phase includes hydrohalogenic acid and nitric acid.

14. The method of claim 13 wherein the organic phase includes hydrohalogenic acid.

15. The method of claim 14 wherein the aqueous phase includes hydrochloric acid (HCl) at a concentration ranging from 9 M to 12 M.

16. The method of claim 14 wherein the aqueous phase antimony concentration of the first extraction stage ranges from 0.3 M to 0.9 M.

17. The method of claim 14 using three to five stages of extraction.

18. The method of claim 14 wherein the volume ratio of aqueous phase to organic phase ranges from 1:1 to 1:1.5.

19. The method of claim 14 wherein at least one extraction stage comprises mixing the organic phase and the aqueous phase for 5-10 min., followed by a phase separation period of 30-60 min.

20. The method of claim 14 wherein NCA radiotin is further separated from at least one of antimony, a radioisotope of tellurium, or a radioisotope of indium by adding an extracted aqueous phase to a sorbent layer in a chromatographic column and running a sorbent washing solution through said column.

21. The method of claim 20 using two to three chromatographic runs.

22. The method of claim 20 wherein the sorbent layer in the chromatographic column is silicon dioxide having grain dimensions ranging from 0.05 mm to 0.4 mm.

23. The method of claim 20 wherein the sorbent layer in the chromatographic column ranges from 5 cm to 15 cm height and 0.5 cm to 1.5 cm diameter.

24. The method of claim 20 wherein sorption is processed in a solution containing citric ions at a concentration at least five times higher than an antimony concentration, but not lower than 0.5 M.

25. The method of claim 24 wherein the citric solution pH ranges from pH 4.5 to pH 6.0.

26. The method of claim 24 wherein the citric solution pH ranges from pH 5.4 to pH 5.6.

27. The method of claim 20 wherein, after sorption, the column is washed by 20 ml to 70 ml 0.5 M sodium citrate, and then by 30 ml to 100 ml water containing citric acid, wherein both solutions have a pH ranging from pH 4.5 to pH 6.

28. The method of claim 27 wherein the pH value of the citric solutions ranges from pH 5.4 to pH 5.6.

29. The method of claim 20 wherein NCA radiotin is subsequently eluted from the chromatographic sorbent by HCl at a concentration ranging from 5 M to 7 M.

30. The method of claim 29 wherein the elution is processed with from 5 ml to 20 ml of HCl.

31. The method of claim 20 wherein said sorbent washing solution passes through said column at an elution rate from 0.1 ml/min to 3 ml/min.

32. The method of claim 1 resulting in NCA radiotin with a specific activity of 500-1500 Ci/g.

* * * * *